US011490189B2

(12) United States Patent
Kirkpatrick

(10) Patent No.: US 11,490,189 B2
(45) **Date of Patent: *Nov. 1, 2022**

(54) RECONFIGURABLE INTRA-AURICULAR SUPPORT

(71) Applicant: Decibullz LLC, Fort Collins, CO (US)

(72) Inventor: Kyle J Kirkpatrick, Fort Collins, CO (US)

(73) Assignee: Decibullz LLC, Fort Collins, CO (US)

( * ) Notice: Subject to any disclaimer, the term of this patent is extended or adjusted under 35 U.S.C. 154(b) by 227 days.

This patent is subject to a terminal disclaimer.

(21) Appl. No.: 16/936,612

(22) Filed: Jul. 23, 2020

(65) Prior Publication Data

US 2020/0359121 A1 Nov. 12, 2020

Related U.S. Application Data

(63) Continuation of application No. 15/684,012, filed on Aug. 23, 2017, now Pat. No. 10,728,648.

(51) Int. Cl.
*H04R 1/10* (2006.01)

(52) U.S. Cl.
CPC ..... *H04R 1/105* (2013.01); *H04R 1/1016* (2013.01); *H04R 1/1058* (2013.01)

(58) Field of Classification Search
CPC .... H04R 1/1016; H04R 1/105; H04R 1/1058; H04R 1/1066
USPC ..... 381/380
See application file for complete search history.

(56) References Cited

U.S. PATENT DOCUMENTS

| | | | |
|---|---|---|---|
| 516,135 | A | 3/1894 | Thamm |
| 904,715 | A | 11/1908 | McWilliams |
| 1,340,512 | A | 5/1920 | Morton |
| 2,377,739 | A | 6/1945 | Wyckoff |
| 2,430,229 | A | 11/1947 | Kelsey |
| 2,521,414 | A | 9/1950 | Schier |
| 2,729,376 | A | 1/1956 | Gould et al. |
| 2,881,759 | A | 4/1959 | Hocks et al. |
| D185,740 | S | 7/1959 | Criswell |
| 3,068,954 | A | 12/1962 | Strzalkowski |
| 3,112,668 | A | 12/1963 | Moshay |
| D206,665 | S | 1/1967 | Sanzone |
| D208,784 | S | 10/1967 | Sanzone |
| 3,415,246 | A | 12/1968 | Hill |
| 3,440,365 | A | 4/1969 | Bryant et al. |
| D215,138 | S | 9/1969 | Makey |

(Continued)

FOREIGN PATENT DOCUMENTS

| | | |
|---|---|---|
| CA | 100610 | 10/2003 |
| CN | 104160719 A | 11/2014 |

(Continued)

OTHER PUBLICATIONS

European Patent Application No. 18741229.1; Extended European Search Report dated Sep. 8, 2020, 12 pages.

(Continued)

*Primary Examiner* — Katherine A Faley
(74) *Attorney, Agent, or Firm* — Craig R. Miles; CR Miles P.C.

(57) ABSTRACT

An earpiece including an intra-auricular support positionable in an auricle of an ear, a portion of the intra-auricular support configured as an intra-auricular support base securable to an earphone housing of an earphone.

14 Claims, 10 Drawing Sheets

(56) References Cited

U.S. PATENT DOCUMENTS

| | | | |
|---|---|---|---|
| 3,810,812 | A | 5/1974 | Koenig |
| D250,033 | S | 10/1978 | Stein |
| D266,271 | S | 9/1982 | Johanson et al. |
| D266,590 | S | 10/1982 | Bennett |
| 4,412,096 | A | 10/1983 | Edgerton et al. |
| D278,363 | S | 4/1985 | Schenkel et al. |
| 4,537,187 | A | 8/1985 | Scott |
| 4,579,112 | A | 4/1986 | Scott |
| D290,203 | S | 6/1987 | Berry, Jr. |
| 4,702,238 | A | 10/1987 | Scott |
| 4,712,245 | A | 12/1987 | Lyregaard |
| 4,880,076 | A | 11/1989 | Ahlberg et al. |
| 4,965,838 | A | 10/1990 | Kamon et al. |
| 5,002,151 | A | 3/1991 | Oliveira et al. |
| 5,048,092 | A | 9/1991 | Yamagishi et al. |
| 5,185,802 | A | 2/1993 | Stanton |
| 5,321,757 | A | 6/1994 | Woodfill, Jr. |
| 5,659,156 | A | 8/1997 | Mauney et al. |
| 5,676,068 | A | 10/1997 | Kallander |
| 5,711,313 | A | 1/1998 | Fleming |
| 5,718,244 | A | 2/1998 | Thornton |
| 5,753,781 | A | 5/1998 | Oxman et al. |
| 5,881,159 | A | 3/1999 | Aceti et al. |
| 5,920,636 | A | 7/1999 | Oliveira et al. |
| 5,950,794 | A | 9/1999 | Porco et al. |
| 6,082,485 | A | 7/2000 | Smith |
| 6,122,388 | A | 9/2000 | Feldman |
| 6,301,367 | B1 | 10/2001 | Boyden et al. |
| 6,310,961 | B1 | 10/2001 | Oliveira et al. |
| 6,354,990 | B1 | 3/2002 | Juneau et al. |
| 6,434,248 | B1 | 8/2002 | Juneau et al. |
| 6,445,865 | B1 | 9/2002 | Janus et al. |
| 6,511,732 | B1 | 1/2003 | Chao |
| 6,595,317 | B1 | 7/2003 | Widmer et al. |
| 6,688,421 | B2 | 2/2004 | Dyer et al. |
| 6,690,807 | B1 | 2/2004 | Meyer |
| 6,761,789 | B2 | 7/2004 | Juneau et al. |
| D505,132 | S | 5/2005 | Linville et al. |
| D527,056 | S | 8/2006 | Manville |
| 7,130,437 | B2 | 10/2006 | Stonikas et al. |
| D535,642 | S | 1/2007 | Garcia et al. |
| 7,217,335 | B2 | 5/2007 | Juneau et al. |
| D550,202 | S | 9/2007 | Meier et al. |
| 7,403,629 | B1 | 7/2008 | Aceti |
| D593,076 | S | 5/2009 | Kung et al. |
| 7,627,131 | B2 | 12/2009 | Nielsen et al. |
| 7,628,366 | B2 | 12/2009 | Scott |
| D622,265 | S | 8/2010 | Rye |
| 7,778,434 | B2 | 8/2010 | Juneau et al. |
| 7,889,883 | B2 | 2/2011 | Cartwright et al. |
| D635,547 | S | 4/2011 | Komiyama |
| D645,458 | S | 9/2011 | Silvestri et al. |
| 8,027,638 | B2 | 9/2011 | Sanguino et al. |
| D647,514 | S | 10/2011 | Wikel et al. |
| D655,693 | S | 3/2012 | Silvestri et al. |
| D656,129 | S | 3/2012 | Kelly et al. |
| 8,184,838 | B2 | 5/2012 | Solomito et al. |
| 8,201,561 | B2 | 6/2012 | Blanchard |
| D667,817 | S | 9/2012 | Otani |
| 8,280,093 | B2 | 10/2012 | Siahaan et al. |
| D716,770 | S | 11/2014 | Bonahoom et al. |
| D721,354 | S | 1/2015 | Thompson et al. |
| 8,931,489 | B2 | 1/2015 | Smith |
| D729,764 | S | 5/2015 | Arjomand |
| D735,169 | S | 7/2015 | Shieh |
| 9,179,211 | B2 | 11/2015 | Kirkpatrick |
| D744,456 | S | 12/2015 | Pedersen |
| D752,026 | S | 3/2016 | Yang |
| D754,638 | S | 4/2016 | Krissman |
| D758,355 | S | 6/2016 | Lee et al. |
| D759,633 | S | 6/2016 | Gondo |
| 9,451,353 | B2 | 9/2016 | Kirkpatrick |
| D773,440 | S | 12/2016 | Pedersen |
| D773,441 | S | 12/2016 | Pedersen |
| 9,628,889 | B2 | 4/2017 | Kirkpatrick |
| D814,443 | S | 4/2018 | Sandanger |
| D828,826 | S | 9/2018 | Schaal |
| D832,240 | S | 10/2018 | Birger |
| D835,077 | S | 12/2018 | Aoyagi et al. |
| D838,693 | S | 1/2019 | Fu |
| D839,243 | S | 1/2019 | Smith et al. |
| D845,282 | S | 4/2019 | Chen |
| D850,417 | S | 6/2019 | Yang |
| D859,368 | S | 9/2019 | Huang |
| D860,172 | S | 9/2019 | Yun |
| D866,532 | S | 11/2019 | Zhang et al. |
| D869,444 | S | 12/2019 | Tang |
| D870,079 | S | 12/2019 | Yun |
| D871,374 | S | 12/2019 | Karayiannis et al. |
| D871,376 | S | 12/2019 | Zhou |
| D875,071 | S | 2/2020 | Wei et al. |
| D879,748 | S | 3/2020 | Lee |
| D881,163 | S | 4/2020 | Duddy et al. |
| D881,164 | S | 4/2020 | Luo |
| D881,849 | S | 4/2020 | Aoyagi et al. |
| D883,262 | S | 5/2020 | Wu |
| D883,959 | S | 5/2020 | Lee |
| 10,728,648 | B2 * | 7/2020 | Kirkpatrick ..... H04R 1/105 |
| D892,085 | S | 8/2020 | Kim |
| D892,089 | S | 8/2020 | Karayiannis et al. |
| D894,158 | S | 8/2020 | Gu |
| D895,572 | S | 9/2020 | Maeda et al. |
| D895,581 | S | 9/2020 | Wu |
| D897,995 | S | 10/2020 | Duddy et al. |
| D902,890 | S | 11/2020 | Williamson et al. |
| D914,650 | S | 3/2021 | Hu |
| D925,493 | S | 7/2021 | Kirkpatrick |
| 2001/0043708 | A1 | 11/2001 | Brimhall |
| 2002/0032362 | A1 | 3/2002 | Juneau et al. |
| 2003/0048916 | A1 | 3/2003 | Chen |
| 2003/0099370 | A1 | 5/2003 | Moore |
| 2005/0147269 | A1 | 7/2005 | Oliveira et al. |
| 2006/0098833 | A1 | 5/2006 | Juneau et al. |
| 2006/0177082 | A1 | 8/2006 | Solomito et al. |
| 2008/0187161 | A1 | 8/2008 | Tiemens et al. |
| 2008/0298626 | A1 | 12/2008 | Dean |
| 2009/0041287 | A1 | 2/2009 | Quinlisk |
| 2009/0190786 | A1 | 7/2009 | Miskiel et al. |
| 2009/0214072 | A1 | 8/2009 | Staab et al. |
| 2009/0232342 | A1 | 9/2009 | Oliveira et al. |
| 2009/0252362 | A1 | 10/2009 | Ooi et al. |
| 2010/0027824 | A1 | 2/2010 | Atamaniuk et al. |
| 2010/0246879 | A1 | 9/2010 | Siahaan |
| 2011/0228963 | A1 | 9/2011 | Goldstein et al. |
| 2011/0255729 | A1 | 10/2011 | Tan et al. |
| 2012/0057739 | A1 | 3/2012 | Smith et al. |
| 2012/0189146 | A1 | 7/2012 | Wuidart |
| 2012/0243701 | A1 | 9/2012 | Parkins et al. |
| 2014/0119589 | A1 | 5/2014 | Wyzisk et al. |
| 2015/0146909 | A1 | 5/2015 | Kirkpatrick |
| 2015/0350761 | A1 | 12/2015 | Heim |
| 2016/0014493 | A1 | 1/2016 | Chen |
| 2016/0073193 | A1 | 3/2016 | Kirkpatrick |
| 2017/0311069 | A1 | 10/2017 | Prevoir et al. |
| 2018/0310089 | A1 * | 10/2018 | Yun ..... H04R 1/1016 |
| 2019/0261079 | A1 | 8/2019 | Okawa et al. |
| 2020/0029161 | A1 | 1/2020 | Thumm et al. |
| 2020/0059715 | A1 | 2/2020 | Hsiao |

FOREIGN PATENT DOCUMENTS

| | | |
|---|---|---|
| CN | 304145346 | 5/2017 |
| CN | 304301289 | 9/2017 |
| EP | 1032243 | 8/2000 |
| EP | 2107827 | 10/2009 |
| GB | 2470177 | 11/2010 |
| IN | 298802-0001 | 10/2017 |
| JP | 2020053853 A | 4/2020 |
| WO | WO 1992/003894 | 3/1992 |
| WO | WO 1999/031935 | 6/1999 |
| WO | WO 00/42817 | 7/2000 |
| WO | WO 2012/024656 | 2/2012 |

(56) References Cited

FOREIGN PATENT DOCUMENTS

WO WO 2018/099562 A1 7/2018
WO WO 2018/136247 A1 7/2018

OTHER PUBLICATIONS

U.S. Appl. No. 15/684,012; Office Action dated Feb. 6, 2019.
U.S. Appl. No. 15/684,012; Office Action dated Jun. 12, 2019.
PCT International Patent Application No. PCT/US18/36724; International Search Report and Written Opinion of the International Searching Authority dated Aug. 30, 2018, 14 pages.
U.S. Appl. No. 15/411,901, filed Jan. 20, 2017.
U.S. Appl. No. 15/481,983, filed Apr. 7, 2017.
Design U.S. Appl. No. 29/599,445, filed Apr. 3, 2017.
U.S. Appl. No. 15/707,953, filed Sep. 18, 2017.
U.S. Appl. No. 15/411,901, Office Action dated Feb. 2, 2018.
U.S. Appl. No. 16/127,120, Office Action dated Feb. 4, 2020.
U.S. Appl. No. 16/198,459, Office Action dated Jun. 12, 2019.
Chinese Patent Application No. 201380013425.X; 2nd Office Action dated Mar. 31, 2017, 8 pages total.
Chinese Patent Application No. 201380013425.X; 3d Office Action dated Aug. 2, 2017, 7 pages total.
Australian Patent Application No. 2018210187, Examination Report No. 1 dated Apr. 17, 2020.
What HI-FI? Dog & Bone earphones include a heating dock to provide a better fit for your earbuds. Website, http://www.whathifi.com, originally downloaded Feb. 10, 2017, total 5 pages.
Sunshine Coast Daily. Earmade: the little QLD idea on world stage. Website, https://www.sunshinecoastaldaily.com.au, total 6 pages.
EarBuddyz 2.0 Ear Hooks and Covers Accessories, announced Dec. 14, 2015 [online], retrieved May 5, 2021, retrieved from internet, https://www.amazon.com/EarBuddyz-Accessories-Compalible-Headphones-Earphones/dp/B019BREFE4.
Far End Gear Budloks Earphone Sport Grips, announced Dec. 9, 2015 [online], retrieved May 5, 2021, retrieved from internet, https://www.amazon.com/Far-End-Gear-Budloks-Earphone/dp/B01950PLKK/ref=asc_df_B01950PLKK/?lag=hyprod-20&linkCode=dto&hvadid=309820150211&hvpos=&hvnetw=g&hvrand=17068762569299593528&hvpone=&hvptwo=&hvqmt=&hvdev=c&hvdvcmdl=&hvlocint=&hvlocphy=9008139&hvtargid=pla-592922917164&psc=1.
Earbuds Eargel Earhooks, announced Dec. 26, 2016 [online], retrieved May 5, 2021, retrieved from internet, https://www.amazon.com/Earbuds-Earhooks-Replacement-Ear-Tips-Earhook/dp/B071YZ4F3Y/ref-asc_df_B071YZ4F3Y/?tag=hyprod-20&linkCode=dfO&hvadid=242108112383&hvpos=&hvnetw=g&hvrand=1639730449777344182&hvpone=&hvptwo=&hvqmt=&hvdev=c&hvdvcmdl=&hvlocint=&hvlocphy=9008139&hvlargid=pla-569399210150&psc=1.
ALXCD Silicone Earhooks for Sony, no announcement date [online], retrieved May 5, 2021, retrieved from internet, https://www.pricepulse.app/alxcd-silicone-earhooks-for-sony-mdr-xb510as-mdr-x_us_2278606.
U.S. Appl. No. 29/714,695, Notice of Allowance dated Jun. 10, 2021, 4 pages.
Corresponding Australian Patent Application No. 2018321556; Examination Report No. 1, dated Dec. 9, 2020, 4 pages.
Australian Patent Application No. 2018210187; Examination Report No. 2, dated Sep. 23, 2020, 4 pages.
U.S. Appl. No. 61/596,567, filed Feb. 8, 2012.
PCT Interantional Patent Application No. PCT/US2013/025288; ISR mailed Jun. 2, 2013, 11 total pages.
Design U.S. Appl. No. 29/536,192, filed Aug. 14, 2015.
Angell. PodFitKit for Apple earbuds announced. iLounge, website, http://www.ilounge.com, originally downloaded Dec. 31, 2012, 4 total pages.
E-Bay. New SUGRU Black 3 pack Moldable Self Setting Rubber Customize Your Earbuds. Website, http://www.ebay.com, originally downloaded Dec. 31, 2012, 4 total pages.
Fuze Custom Earphones. On-line Catalog, http://www.earfuze.com, originally downloaded Dec. 31, 2012, 1 page.
How-To Geek. How to Make Custom Silicone Ear Molds for Your In-Ear Monitors. Website, http://www.howtogeek.com, originally downloaded Dec. 31, 2012, 20 total pages.
Lloyds. Custom Ear Mold—Standard. On-line Catalog, http://lloydhearingaid.com, originally downloaded Dec. 31, 2012, 1 page.
mylobie.com. Lobies—comfortable earbuds adapters for iPod, iPhone, and portable audio.Website, http://www.mylobie.com, originally downloaded Dec. 31, 2012, 1 page.
Zapconnect. Hearing Aid Moldable Impression Silicone Putty. Website, http://www.zapconnect.com, originally downloaded Dec. 31, 2012, 1 page.
Zenplugs Moulded Earplug Shop. Zenpods Blue Molded Earphone Adaptors . . . On-line Catalog, http://shop.zenplugs.com, originally downloaded Dec. 24, 2013, 1 page.
FLUGZ. Advanced Hearing Protection. Website, https://www.flugz.com, originally downloaded Aug. 17, 2015, 15 pages total.
FLUGZ. Form and Fit. Website, https://www.flugz.com, originally downloaded Aug. 17, 2015, 3 pages total.
FLUGZ. Why FLUGZ. Website, https://www.flugz.com, originally downloaded Aug. 17, 2015, 3 pages total.
FLUGZ. Advanced Hearing Protection. Website, https://www.flugz.com, originally downloaded Aug. 17, 2015, 2 pages total.
European Patent Application No. 13746012.7; European Search Report, dated Jan. 27, 2016, 6 pages total.
Chinese Patent Application No. 201380013425.X; Office Action and Search Report dated Oct. 8, 2016, 8 pages total.
European Patent Application No. 13746012.7; Office Action dated Nov. 18, 2016, 5 pages total.
U.S. Appl. No. 15/684,012, filed Aug. 23, 2017.
Corresponding European Patent Application No. 18848591.6, Supplementary European Search Report dated Mar. 3, 2021, 8 pages.
Corresponding Chinese Patent Application No. 201880054628.6, First Office Action dated Jun. 21, 2021, 7 pages.
U.S. Appl. No. 16/465,652; Office Action dated Jan. 22, 2020.
U.S. Appl. No. 16/465,652; Notice of Allowance dated Jul. 1, 2020.

* cited by examiner

RECONFIGURABLE INTRA-AURICULAR SUPPORT

This United States Patent Application is a continuation of U.S. patent application Ser. No. 15/684,012, Aug. 23, 2017, now U.S. patent Ser. No. 10/728,648, issued Jul. 28, 2020, hereby incorporated by reference herein.

I. TECHNICAL FIELD

An earpiece including an intra-auricular support positionable in an auricle of an ear, a portion of the intra-auricular support configured as an intra-auricular support base securable to an earphone housing of an earphone.

II. BACKGROUND

Conventional earphones do not provide a substantially rigid earpiece configured to the outer ear of the individual wearer, or the individual wearer cannot configure a substantially rigid earpiece to the outer ear. Because the earphone is not configured to the individual wearer's outer ear, the earpiece may not stay in fixed engagement with the outer ear, the earphone may not align with the outer portion of the ear canal, or the earphone may be uncomfortable for the wearer to insert into or retain in the outer ear. The instant invention provides an earpiece which overcomes in whole or in part certain of the foregoing disadvantages of conventional earpieces.

III. SUMMARY OF THE INVENTION

A broad object of the invention can be to provide an earpiece including one or more of: an intra-auricular support having an intra-auricular support external surface positionable in an auricle of an ear, wherein a portion of the intra-auricular support external surface can be configured as an intra-auricular support base securable to an earphone housing of an earphone, the intra-auricular support secured by the intra-auricular support base to the earphone housing being positionable in the auricle of the ear.

Another broad object of the invention can be to provide a method of making an earpiece including one or more of: configuring an intra-auricular support external surface of an intra-auricular support to position in an auricle of an ear, and configuring a portion of the intra-auricular support external surface as an intra-auricular support base securable to an earphone housing of an earphone, the intra-auricular support secured by the intra-auricular support base to the earphone housing being positionable in the auricle of the ear.

Another broad object of the invention can be to provide a method for using an earpiece including one or more of: obtaining an intra-auricular support having an intra-auricular support external surface positionable in an auricle of an ear, the intra-auricular support having a portion configured as an intra-auricular support base securable to an earphone housing of an earphone, obtaining an earphone having an earphone housing, securing the intra-auricular support base the earphone housing of the earphone, and positioning the intra-auricular support secured by the intra-auricular support base to said earphone housing in the auricle of said ear upon insertion of the earphone into the ear.

Naturally, further objects of the invention are disclosed throughout other areas of the specification, drawings, photographs, and claims.

IV. A BRIEF DESCRIPTION OF THE DRAWINGS

V. DETAILED DESCRIPTION OF THE PREFERRED EMBODIMENTS

Figure 1:
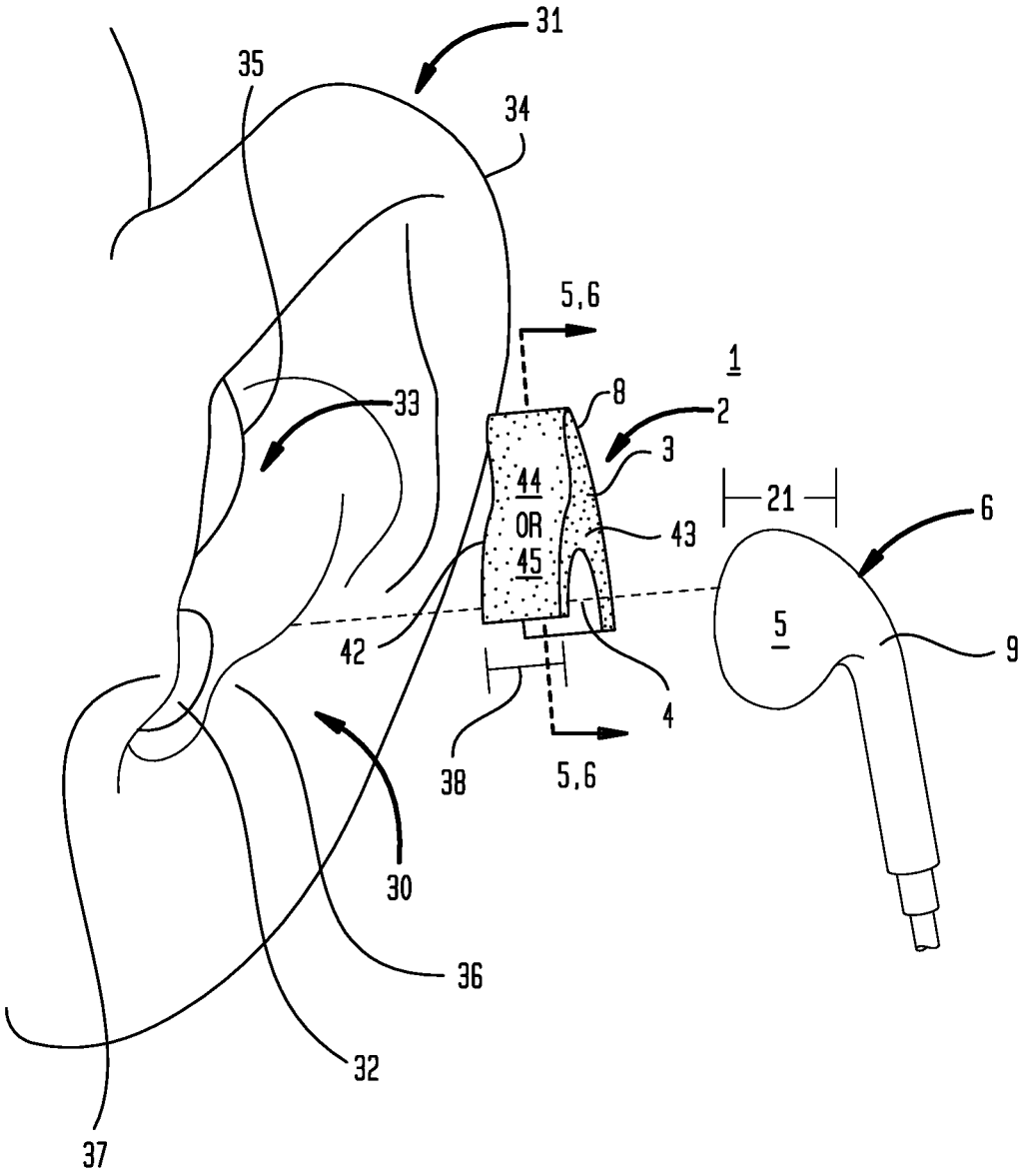
FIG. 1 is an exploded view of a particular embodiment of an earpiece.
Figure 5:
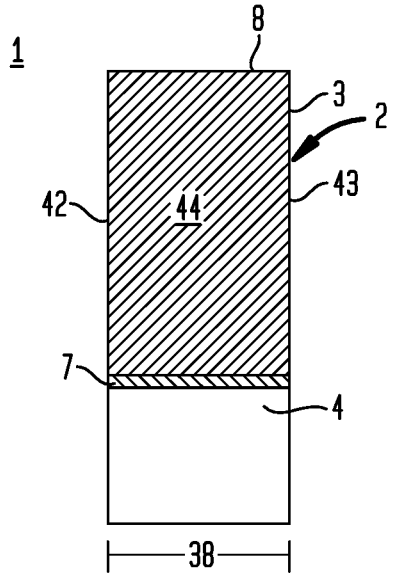
FIG. 5 is a cross-sectional view of a particular embodiment of an intra-auricular support.

In general, an earpiece (1) can include one or more of: an intra-auricular support (2) having an intra-auricular support external surface (3) and an intra-auricular support base (4) securable to an earphone housing (5) of an earphone (6). Referring primarily to FIG. 1, the intra-auricular support (2) can include an intra-auricular support external surface (3). The intra-auricular support external surface (3) can include a portion configured as an intra-auricular support base (4). The intra-auricular support base (4) can be secured to an earphone housing (5) of an earphone (6). Embodiments can, but need not necessarily, include an adhesion element (7) disposed on the intra-auricular support base (4) capable of securing the intra-auricular support base (4) to the earphone housing (5) (as shown in the examples of FIG. 5. 6 or 7). The adhesion element (7) allows securement of the intra-auricular support base (4) to the earphone housing (5) of the earphone (6) through one or more of adherence of the intra-auricular support material (8) to the earphone housing (5), welding to join the intra-auricular support material (8) to the earphone housing material (9) of the earphone housing (5), adhesives compatible with bonding the intra-auricular support material (8) to the earphone housing material (9) of the earphone housing (5), pliant layers including adhesive on opposed sides, friction fit between the configuration of the intra-auricular support (2), or other similar adhesion elements (7).

Figure 2:
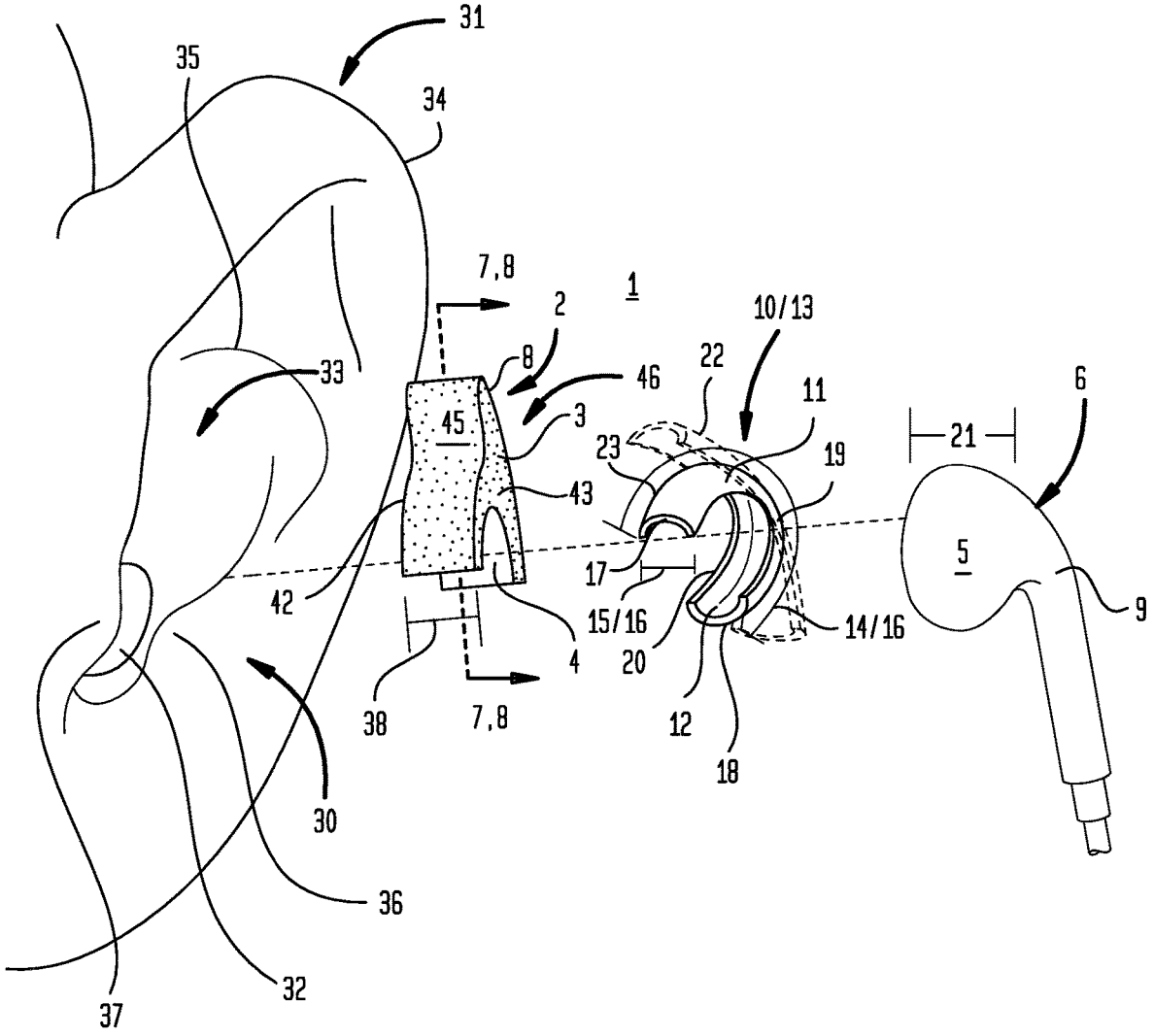
FIG. 2 is an exploded view of a particular embodiment of an earpiece including a base member.

Now referring primarily to FIG. 2, embodiments of the intra-auricular support (2) can, but need not necessarily, include a base member (10) having a base member first surface (11) fixedly or removably engaged to the intra-auricular support base (4). The base member (10) can have a base member second surface (12) having a fixed or flexible configuration securable to an earphone housing (5) of an earphone (6). As shown by the illustrative example of FIG. 2, the base member (10) can have an arcuate body (13) having a base member length (14), and a base member width (15).

As to particular embodiments, the base member length (14) can, but need not necessarily, include a base member curvature (16), which allows the base member second surface (12) to mateably secure in overlying engagement with corresponding curvature of the earphone housing (5) of the earphone (6). In particular embodiments, the base member curvature (16) can, but need not necessarily, include an arc measure extending between opposite arcuate body first and second ends (17)(18) of about 45 degrees to about 270 degrees. The arc measure of the base member curvature (16) between opposite arcuate body first and second ends (17)(18) can be selected from the group including or consisting of: about 50 degrees to about 70 degrees, about 60 degrees to about 80 degrees, about 70 degrees to about 90 degrees, about 80 degrees to about 100 degrees, about 90 degrees to about 110 degrees, about 100 degrees to about 120 degrees, about 110 degrees to about 130 degrees, about 120 degrees to about 140 degrees, about 130 degrees to about 150 degrees, about 140 degrees to about 160 degrees, about 150 degrees to about 170 degrees, about 160 degrees to about 180 degrees, about 170 degrees to about 190 degrees, about 180 degrees to about 200 degrees, about 190 degrees to about 210 degrees, about 200 degrees to about 220 degrees, about 210 degrees to about 230 degrees, about 220 degrees to about 240 degrees, about 230 degrees to about 250 degrees, about 240 degrees to about 260 degrees, and combinations thereof.

Again, referring primarily to the example of FIG. 2, the base member width (15) can, but need not necessarily, include a base member curvature (16) between opposite base member first and second sides (19)(20) which allows the base member second surface (12) to mateably secure in overlying engagement with the corresponding configuration of the earphone housing (5) of the earphone (6). The base member width (15) extending from opposite base member first and second sides (19)(20) can be less than, greater than, or substantially equal to the earphone housing width (21). In further embodiments, an adhesion element (7) can, but need not necessarily, be disposed on the base member first surface (11), the base member second surface (12), or both.

Figure 3:
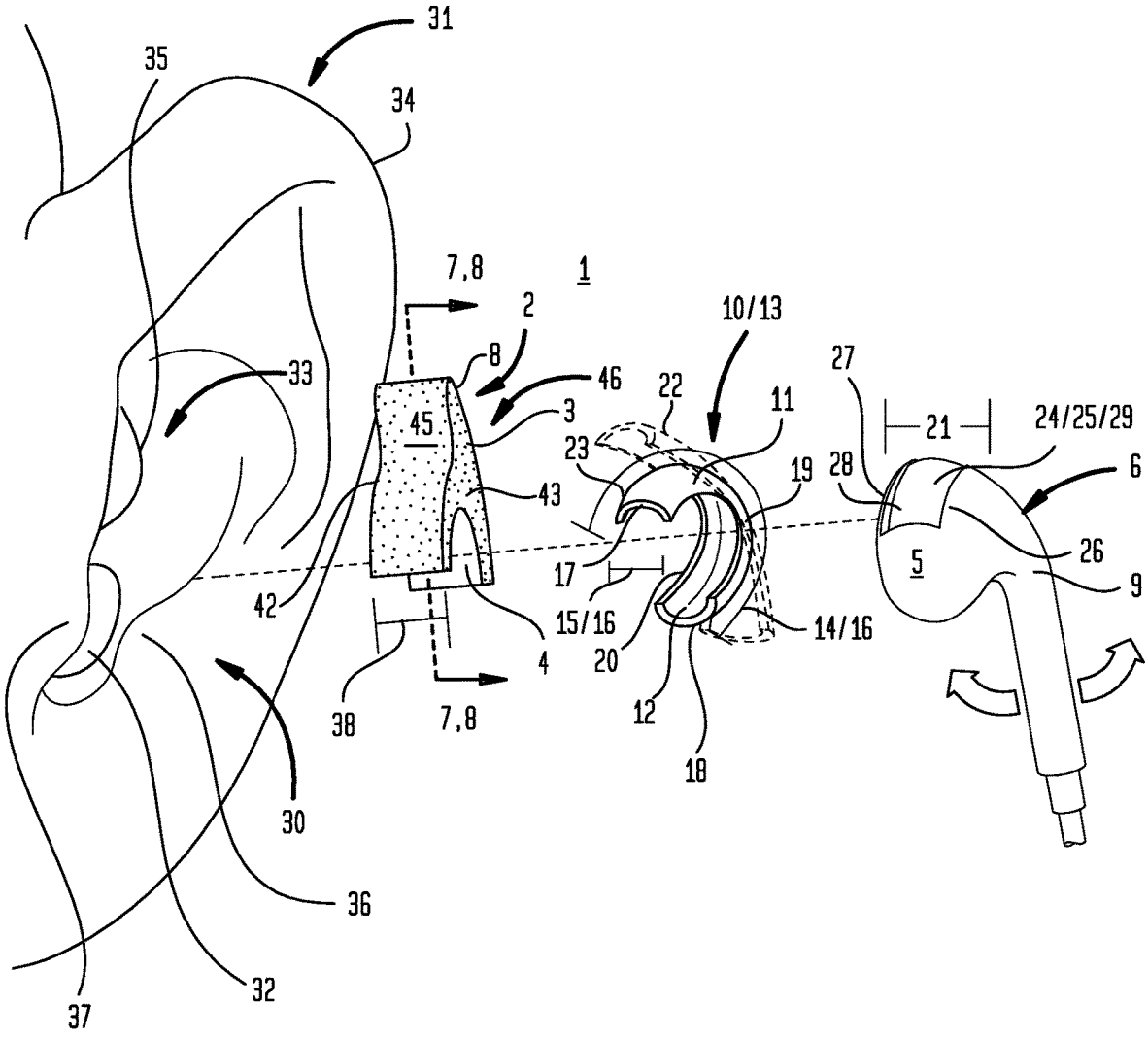
FIG. 3 is an exploded view of a particular embodiment of an earpiece including a base member securable to a base member securement element of an earphone.

Again, referring primarily to FIGS. 2 and 3, the base member (10) can, but need not necessarily, further include a resiliently flexible arcuate body (13) having a flexed condition (22) which allows the earphone housing (5) to pass between the opposed arcuate body first and second body ends (17)(18), and which returns to an unflexed condition (23) which retains the earphone housing (5) in mated engagement with the base member second surface (12).

Now referring primarily to FIG. 3, the earphone housing (5) can further include a base member securement element (24) disposed on or in the earphone housing (5) which mateably receives the base member (10). As shown in the illustrative example of FIG. 3, the earphone housing (5) can further include a base member securement element (24) in the form of an open sided channel (25) having one or a pair of opposed side walls (26)(27) upwardly extending from a channel base (28). The resiliently flexible arcuate body (13) can flex as above described to be disposed in the open sided channel (25). As to particular embodiments, the open sided channel (25) can circumferentially extend in whole or in part about the earphone housing (5). The open sided channel (25) can slidably engage the resiliently flexible arcuate body (13) to allow the earphone housing to rotate in relation to the intra-auricular support (2).

Figure 4:
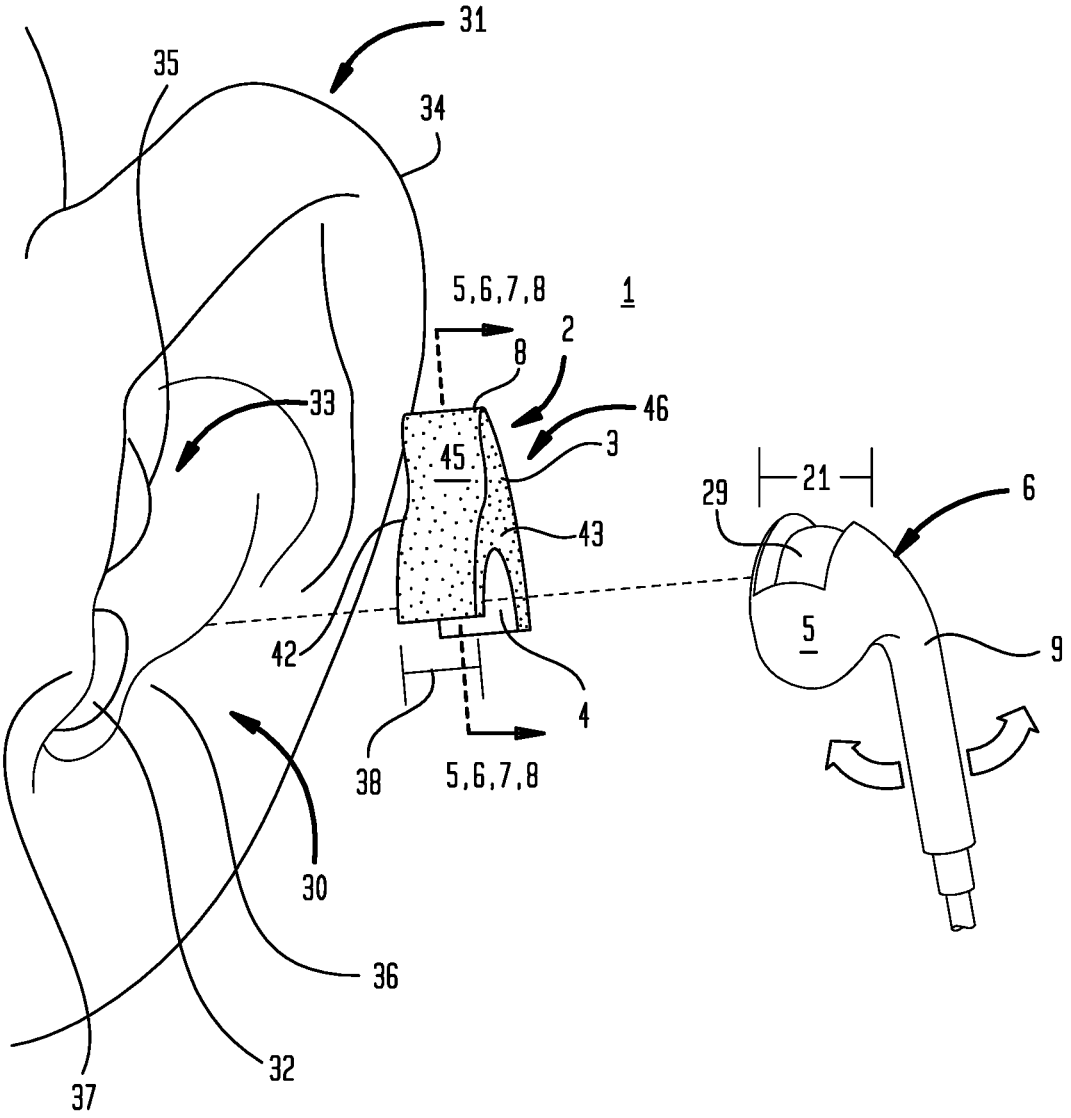
FIG. 4 is an exploded view of a particular embodiment of an intra-auricular support having an external surface a portion of which can be positioned in a socket element disposed on an earphone.

Now referring primarily to FIG. 4, as to particular embodiments, the earphone housing (5) can include a socket (29) which mateably engages a portion of the intra-auricular support (2) proximate the intra-auricular support base (4) to secure or removably secure the intra-auricular support (2) to the earphone housing (5) of the earphone (6).

Now referring primarily to FIGS. 9 through 15, embodiments of the intra-auricular support (2) can be positioned in an auricle (30) of an ear (31). For purposes of this invention, the term, "auricle (30)" means the area of the ear (31) extending from the external ear canal opening (32) to the concha bowl (33), and to the peripheral outer edge (34) of the ear (31). In some embodiments of the earpiece (1), the intra-auricular support (2) can be configured to be disposed in the concha bowl (33). The intra-auricular support (2) can be removably retained in the concha bowl (33) by contact of one or more of: the antihelix (35), antitragus (36), or tragus (37) with the corresponding portions of the intra-auricular support (2). The intra-auricular support (2) can, but need not necessarily, have a depth (38) disposed between a first side (42) and a second side (43) which can be substantially equal to the depth (39) extending from the bottom (40) of the concha bowl (33) to the top surface (41) of the antihelix (35). A first side (42) of the intra-auricular support (2) can be configured to substantially conform to the contour of the portion of the auricle (30) or concha bowl (33) of the ear (31) with the second side (43) of the intra-auricular support (2) positioned behind the tragus (37) and antitragus (36) or the antihelix (35). The intra-auricular support base (4) can, but need not necessarily, be configured to the contour of the earphone housing (5) of the earphone (6).

Now referring primarily to FIGS. 1 and 5, embodiments of the intra-auricular support (2) can be fabricated, formed, or molded from an amount of a pliant solid (44). For purposes of this invention, the term "pliant" means sufficiently pliable to bend freely or repeatedly without breaking. The pliant solid (44) can have an intra-auricular support external surface (3) that can be reconfigurable upon engagement with the auricle (30) of the ear (31). The pliant solid (44) material can be selected from the group including or consisting of: acrylic, nylon, acrylonitrile butadiene styrene, polylactic acid, polybenzimidazole, polycarbonate, polyether sulfone, polyethylene, urethane, silicone, or other pliant elastomers, or combinations thereof.

Figure 6:
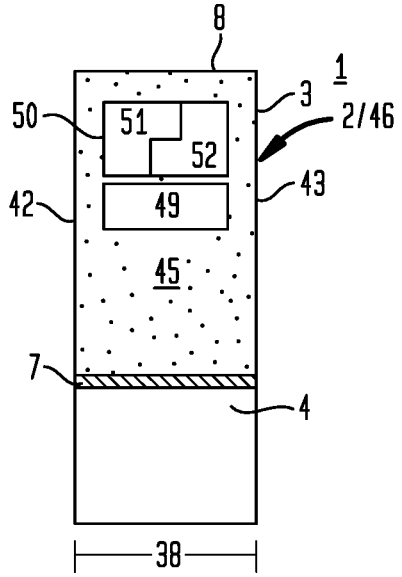
FIG. 6 is a cross-sectional view of a particular embodiment of an intra-auricular support.
Figure 7:
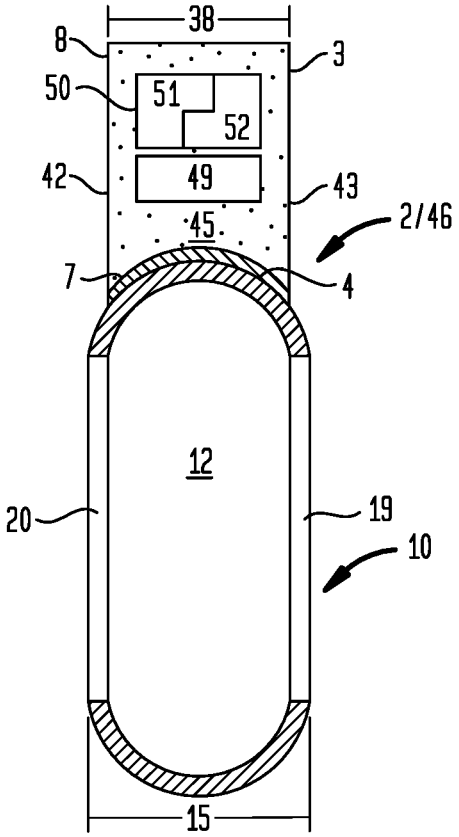
FIG. 7 is a cross-sectional view of a particular embodiment of an intra-auricular support including a base member.
Figure 8:
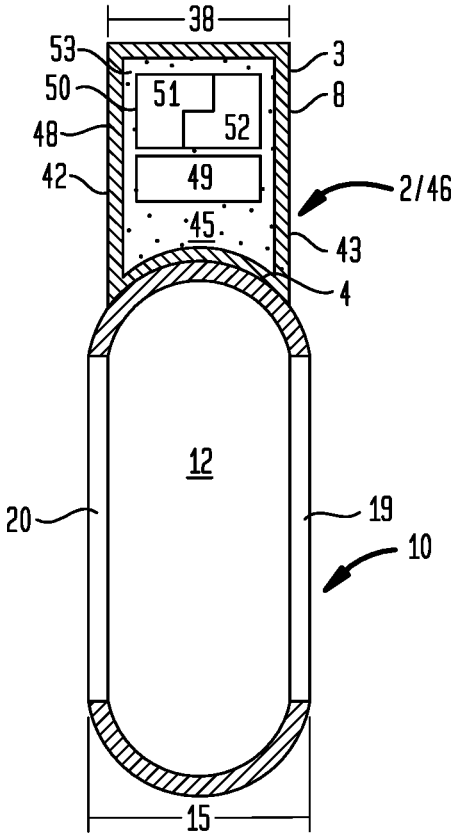
FIG. 8 is a cross-sectional view of a particular embodiment of an intra-auricular support including a base member and a pliant outer layer overlying a moldable material.
Figure 9:
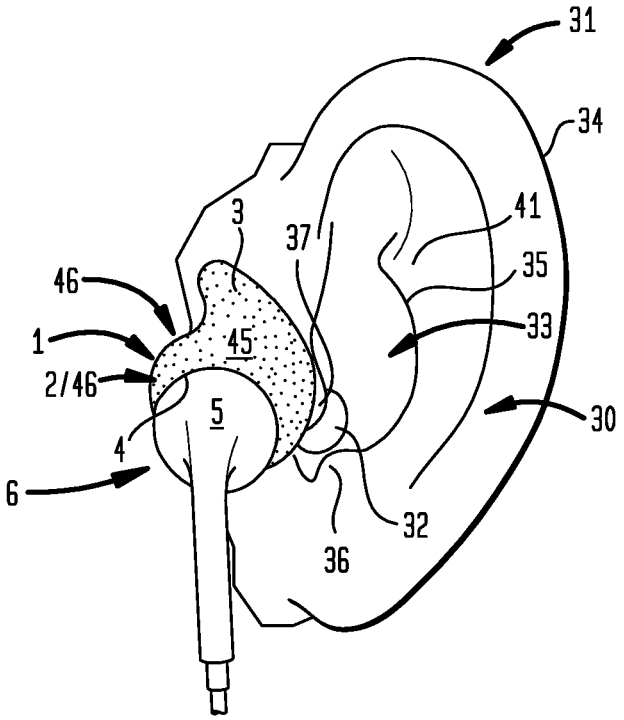
FIG. 9 is a front elevation view of a particular embodiment of an earpiece secured to an earphone prior to positioning in the ear.

Now referring primarily to FIGS. 1 through 4 and 6 and 7, embodiments of the intra-auricular support (2) can be fabricated, formed, or molded from an amount of a moldable support material (45). The moldable support material (45) can define a first-fixed configuration (46) of the intra-auricular support (2) positionable in the auricle (30) of the ear (31) (as shown in the examples of FIGS. 9 and 11). The moldable support material (45) can be heatable to achieve a moldable condition. The moldable condition can allow reconfiguration of the moldable support material (45) upon engagement with the auricle (30) of the ear (31). The moldable support material (45) can be coolable while engaged with the auricle (30) of the ear (31) to dispose the moldable support material (45) in a second fixed configuration (47) of the intra-auricular support (2) (as shown in the examples of FIGS. 10, 12, and 13 through 15). As shown in FIGS. 7 and 8, the moldable support material (45) can, but need not necessarily, further be fixedly engaged to the base member first surface (11) of the base member (10) in particular embodiments.

Figure 14:
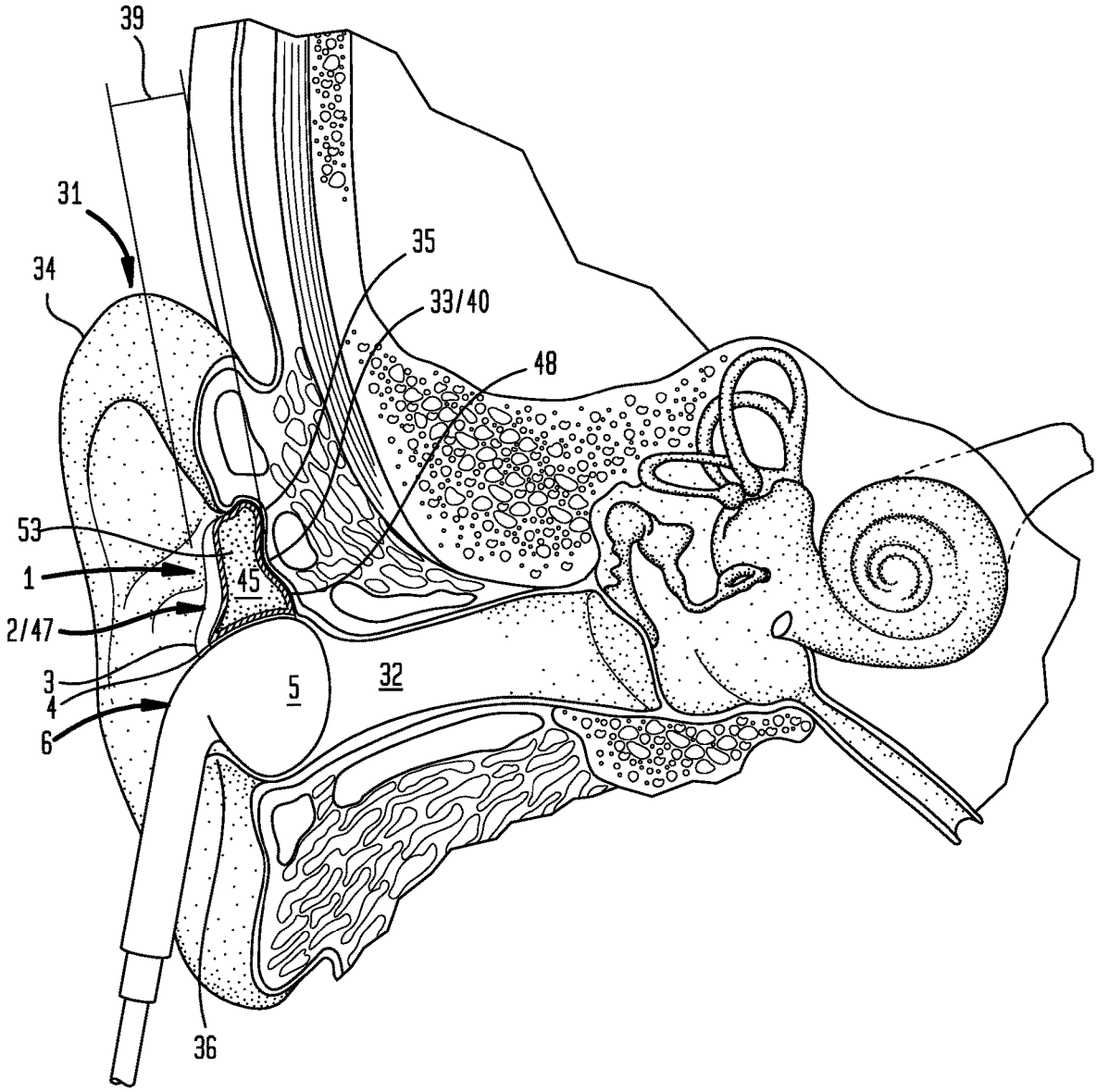
FIG. 14 is a cross-sectional view of an ear and cross-sectional view of the particular embodiment of the earpiece shown in FIG. 8 secured to an earphone positioned in the ear.

Now referring primarily to FIG. 8, embodiments of the intra-auricular support (2) can further include a pliant outer layer (48) disposed over the moldable support material (45). The moldable support material (45) overlaid by the pliant outer layer (48) can define a first fixed configuration (46) of the intra-auricular support (2) positionable in the auricle (30) of the ear (31). The moldable support material (45) overlaid or enclosed by the pliant outer layer (48) can be heated to achieve a moldable condition of the moldable support material (45). The moldable condition can allow reconfiguration of the moldable support material (45) by engaging the pliant outer layer (48) with the auricle (30) of the ear (31). While the pliant outer layer (48) engages the auricle (30) of the ear (31), the moldable support material (45) can be cooled to dispose the moldable support material (45) in the second fixed configuration (47) of the intra-auricular support (2) (as shown in the example of FIG. 14) removably positionable in the auricle (30) of the ear (31). As shown in FIG. 8, the moldable support material (45) can, but need not necessarily, further be fixedly engaged to the base member first surface (11) of the base member (10).

The term "moldable support material (45)" means, for the purpose of this invention, a material reconfigurable by direct engagement, or as to those embodiments having a pliant outer layer (48) indirect engagement with the auricle (30) of the ear (31), and which upon reconfiguration retains a fixed configuration corresponding to the engaged portion of the auricle (30) of the ear (31). As to particular embodiments, the moldable support material assumes the moldable condition in a temperature range of about 40° C. (about 110° F.) to about 65° C. (150° F.) and assumes a fixed configuration at temperatures below about 40° C. (110° F.). As to particular embodiments, the material remains moldable at ambient temperature and transitions from a moldable condition to a fixed configuration by exposure to one or more external factors such as: moisture or ultraviolet light. As to those embodiments, including a base member (10) having a base member first surface (11) fixedly engaged or joined to the intra-auricular support (2), the base member (10) can be of a material which remains in a stable fixed configuration during reconfiguration of the moldable support material (45), thereby achieving a reconfigured moldable support material (45) without alteration or while substantially retaining the configuration of the base member (10) whether secured or securable to the earphone housing (6).

As shown in the illustrative examples of FIGS. 6 through 8, the moldable support material (45) can be a one-part moldable support material (49). The one-part moldable support material (49) can be selected from the group including or consisting of: thermoplastic polymers such as polyethylene, polypropylene, polyvinyl chloride (PVC), polystyrene, polytetrafluoroethylene (PTFE, commonly known as TEFLON®), acrylonitrile butadiene styrene, ethyl vinyl acetate, polycaprolactone, silicone, or combinations thereof.

As one illustrative example, the one-part moldable support material (49) can be an amount of polycaprolactone polymer (CAS No.: 24989-40-4) having the properties described in Table 1; however, this illustrative example is not intended to preclude the use of other thermoplastic polymers, or combinations of thermoplastic polymers, or other polymers, suitable for use with embodiments of the earpiece (1).

TABLE 1

Physical Properties of Polycaprolactone Thermoplastic Polymers

| Physical Property | ASTM Test | | | |
|---|---|---|---|---|
| Molecular Weight | | | | |
| Mn | GPC, THF, 25° C. | 37,000 ± 2000; | 47500 ± 2000; | 69000 ± 1500 |
| Mw | GPC, THF, 25° C. | | 84500 ± 1000; | 120000 ± 2000 |
| Mz | GPC, THF, 25° C. | | 130000 ± 5000; | 178500 |
| Polydispersity (Mw/Mn) | | | 1.78 | 1.74 |
| Melt Flow Index | D 1238 | | | |
| 80° C., 2.16 kg, g/10 min | | | 2.36 | 0.59 |
| 80° C., 21.6 kg, g/10 min | | | 34.6 | 9.56 |
| 190° C., 2.16 kg, g/10 min | | | 28 | 7.29 |
| Thermal Analysis (DSC) | | | | |
| Melting Point ° C. | | | 60-62 | 60-62 |
| Heat Of Fusion, DHm, J/g | | | 76.9 | 76.6 |
| Crystallinity, % | | | 56 | 56 |
| Crystallisation Temperature, ° C. | | | 25.2 | 27.4 |
| Glass Transition Temperature, Tg,° C. | | | −60 | −60 |

TABLE 1-continued

| Physical Properties of Polycaprolactone Thermoplastic Polymers | | | |
|---|---|---|---|
| Physical Property | ASTM Test | | |
| Tensile Properties | | | |
| Yield Stress, s y, MPa | D 412-87 | | |
| 100 mm/min | | 17.5 | 16 |
| 500 mm/min | | 17.2 | 14 |
| Modulus, E. MPa | D 412-87 | | |
| 1 mm/min | | 470 | 440 |
| 10 mm/min | | 430 | 500 |
| Draw Stress, s d, MPa | D 412-87 | | |
| 100 mm/min | | 12.6 | 11.9 |
| 500 mm/min | | 11.5 | 11 |
| Draw Ratio, 1 d, x | D 412-87 | | |
| 100 mm/min | | >4.2 | 4 |
| Stress At Break, s b, MPa | D 412-87 | | |
| 100 mm/min | | 29 | 54 |
| Strain At Break, e b, % | | | |
| 100 mm/min | D 412-87 | >700 | 920 |
| Flexural Modulus, E, MPa | | | |
| 2 mm/min | D 790 | 411 | nd |
| Hardness | D 2240 | | |
| Shore A | | 95 | 94 |
| Shore D | | 51 | 50 |
| Viscosity | | | |
| Pa · sec, 70° C., 10 1/sec | | 2890 | 12650 |
| Pa · sec, 100° C., 10 1/sec | | 1353 | 5780 |
| Pa · sec, 150° C., 10 1/sec | | 443 | 1925 |

Polycaprolactone polymers can be heated to achieve a moldable condition, reconfigured or contoured by pressing engagement to a portion of the auricle (30) or concha bowl (33) of the ear (31) and cooled while engaged to the auricle (30) or concha bowl (33) to achieve the fixed configuration of the intra-auricular support (2).

Polycaprolactone polymers impart good water, oil, solvent, and chlorine resistance. Polycaprolactone polymers are also compatible with a wide range of other materials (collectively referred to as "admixed agents"), such as: starch, to impart greater biodegradability; colorants, such as alcohol dyes or acrylic coloring agents; powders, such as acrylic powder; particulates of plastic, copolymer plastics, metal, bismuth oxychloride, or glitter, or the like, either separately or in various combinations. Polycaprolactone polymers are non-toxic and approved by the United States Food and Drug Administration for specific applications in the human body.

Again, referring primarily to FIGS. 6 through 8, as to particular embodiments, the moldable support material (45), can include a two-part moldable support material (50) including or consisting of a moldable agent (51) combinable with a curing agent (52) which can be mixed together prior to molding, which is capable of achieving a moldable condition. Concurrently, the two-part moldable support material (50) can be molded to the contour of the auricle (30) or the concha bowl (33) of the ear (31). After molding the two-part moldable support material (50), the two-part moldable support material (50) can then cure over a period of time at ambient temperature (or at a temperature greater or lesser than ambient temperature) to provide a fixed configuration of the two-part moldable support material (50).

Illustrative examples of a two-part moldable support material (50) include: a crosslinkable polymer having at least one hydrolysable silane group, selected from the group including or consisting of: silane-modified polyoxyalkylenes, polyolefins, poly(meth)acrylates, polyurethanes, polyamides, and polysiloxanes; silicone putty partially hydrolyzed alkyl silicate, or combinations thereof, and a catalyst including: a metallic salt of an organic carboxylic acid catalyst in which the metal comprises or consists of one or more of a platinum, tin, copper, or other metal causing the crosslinking of the polymer.

Another illustrative example of a two-part moldable support material (50) including a moldable agent (51) and curing agent (52) comprises polydimethylsiloxane polymer and platinum (0)-1,3-divinyl-1,1,3,3-tetramethyldisiloxane curing agent. Another illustrative example of a two-part moldable support material (50) including a moldable agent (51) and curing agent (52) comprises two proprietary compounds manufactured by Radians, Inc. silicone putty A-side and silicone putty B-side, of which one silicone putty contains methylpolysiloxanes.

Yet another illustrative example includes SILPURAN® 8020, a platinum catalyst-curing solid silicone rubber available through Wacker Chemie AG.

TABLE 2

| Physical Properties of SILPURAN ® 8020 | |
|---|---|
| Hardness - Shore A (DIN 54615) | 62 |
| Cure System | Platinum (100:1.5 Base + catalyst) |
| Specific Gravity (DIN 54589 A) | 1.16 g/cm$^3$ |
| Tensile Strength (DIN 54614S1) | 10.5 N/mm$^2$ |
| Elongation at break (DIN54614S1) | 751% |
| Rebound Resilience (DIN54622) | 58% |
| Tear Resistance (ASTM D624B) | 30 N/mm$^2$ |
| Compression set (22 h/175° C.) (DIN ISO815-B) | 30% |
| Appearance - Translucent | |

Figure 15:
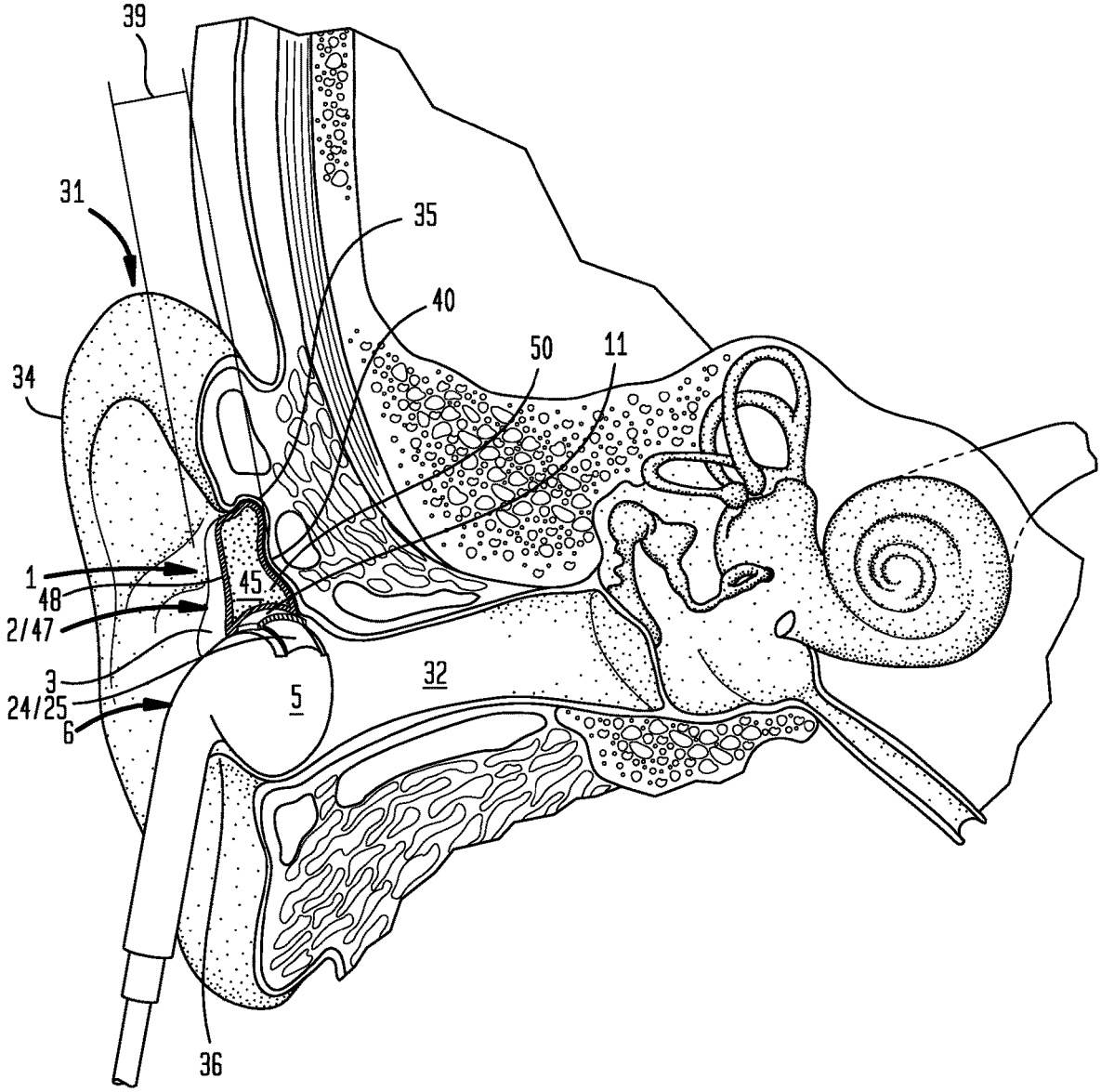
FIG. 15 is a cross-sectional view of an ear and a cross-sectional view of the particular embodiment of an earpiece shown in FIG. 7 or 8 having a base member secured to an earphone positioned in the ear.

Now referring primarily to FIGS. 8 and 14 through 15, in embodiments having a pliant outer layer (48), the pliant outer layer (48) can be fabricated, formed, or molded from a wide variety of materials such as: thermoplastic urethane, thermoplastic olefins, thermoplastic copolyester, thermoplastic polyamides, silicone rubber, polybutadiene, or combinations thereof having a greater, lesser, or substantially equal hardness to the moldable support material (50).

Figure 10:
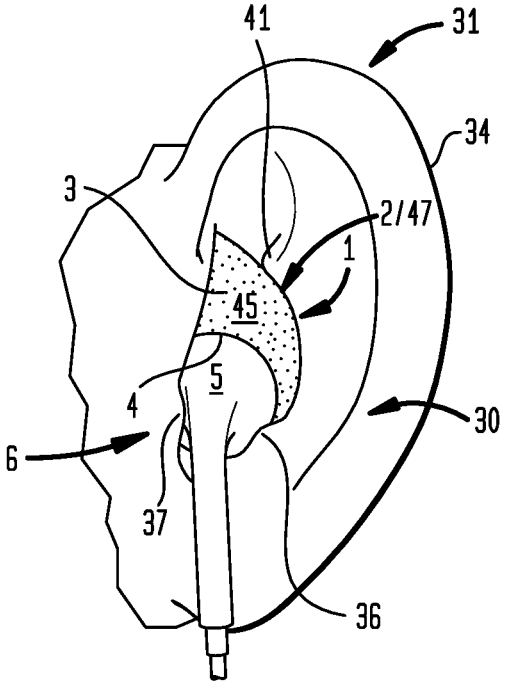
FIG. 10 is a front elevation view of a particular embodiment of an earpiece secured to an earphone positioned in the ear.
Figure 11:
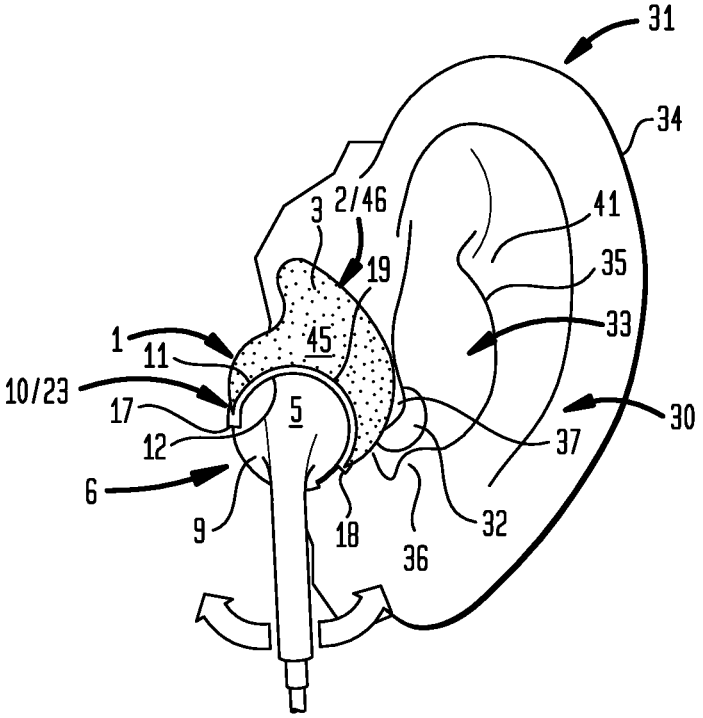
FIG. 11 is a front view of a particular embodiment of an earpiece having a base member secured to an earphone prior to positioning in the ear.
Figure 12:
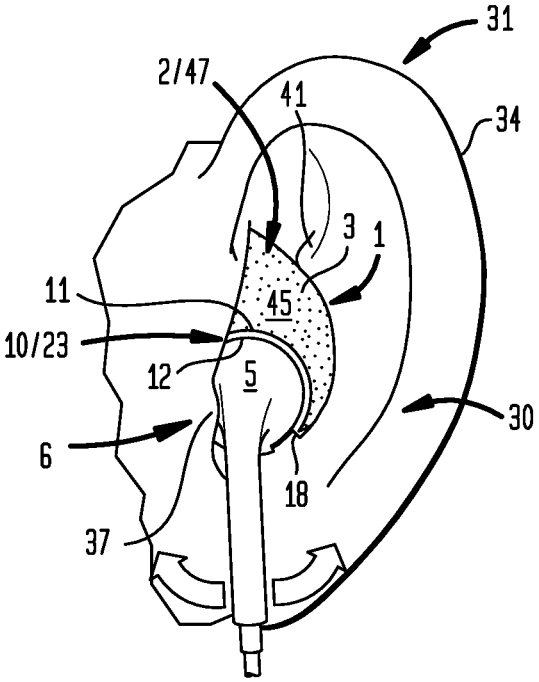
FIG. 12 is a front view of a particular embodiment of an earpiece having a base member secured to an earphone positioned in the ear.

Now referring primarily to FIGS. 9 through 12, methods of using the earpiece (1) can include one or more of: obtaining an earphone (6) having an earphone housing (5), obtaining an intra-auricular support (2) having an intra-auricular support external surface (3) positionable in an auricle (30) of an ear (31) and a portion of the intra-auricular support external surface (3) configured as an intra-auricular support base (4) securable to an earphone housing (5) of an earphone (6), and securing the earphone housing (5) of the earphone (6) directly to the intra-auricular support base (4) (as shown in the illustrative examples of FIGS. 9 and 10). By way of illustration and as a non-limiting example, an earphone can be APPLE® EARPODS®, Model No. MMTN2AM/A. A second non-limiting example can be SONY® EX Series Earbud Headphones, Model No. MDREX15LP/B. As to further embodiment, methods of using the earpiece can include securing the intra-auricular support base (4) to a base member first surface (11) and securing the base member second surface (12) to the earphone housing (5) of the earphone (6) (as shown in the examples of FIGS. 11 and 12).

Securement of the earphone (6) to the intra-auricular support (2) can be achieved prior to (as shown in the examples of FIGS. 9 through 12) or after disposing the earpiece (1) in the ear (31). For example, securement of the intra-auricular support (2) to the earphone housing (5) can be achieved by disposing the intra-auricular support (2) and earphone (6) in the ear (31) as separate components prior to securing. Thus, the method of using the earpiece (1) can further include positioning the intra-auricular support (2) in the auricle (30) of the ear (31) and inserting the earphone (6) into the ear (31) prior to securing the earphone housing (5) to the intra-auricular support base (4). By way of further example, the method of using the earpiece (1) can further include inserting the earphone (6) into the ear (31) and positioning the intra-auricular support (2) in the auricle (30) of the ear (31) prior to securing the earphone housing (5) of the earphone (6) to the intra-auricular support base (4).

Figure 13:
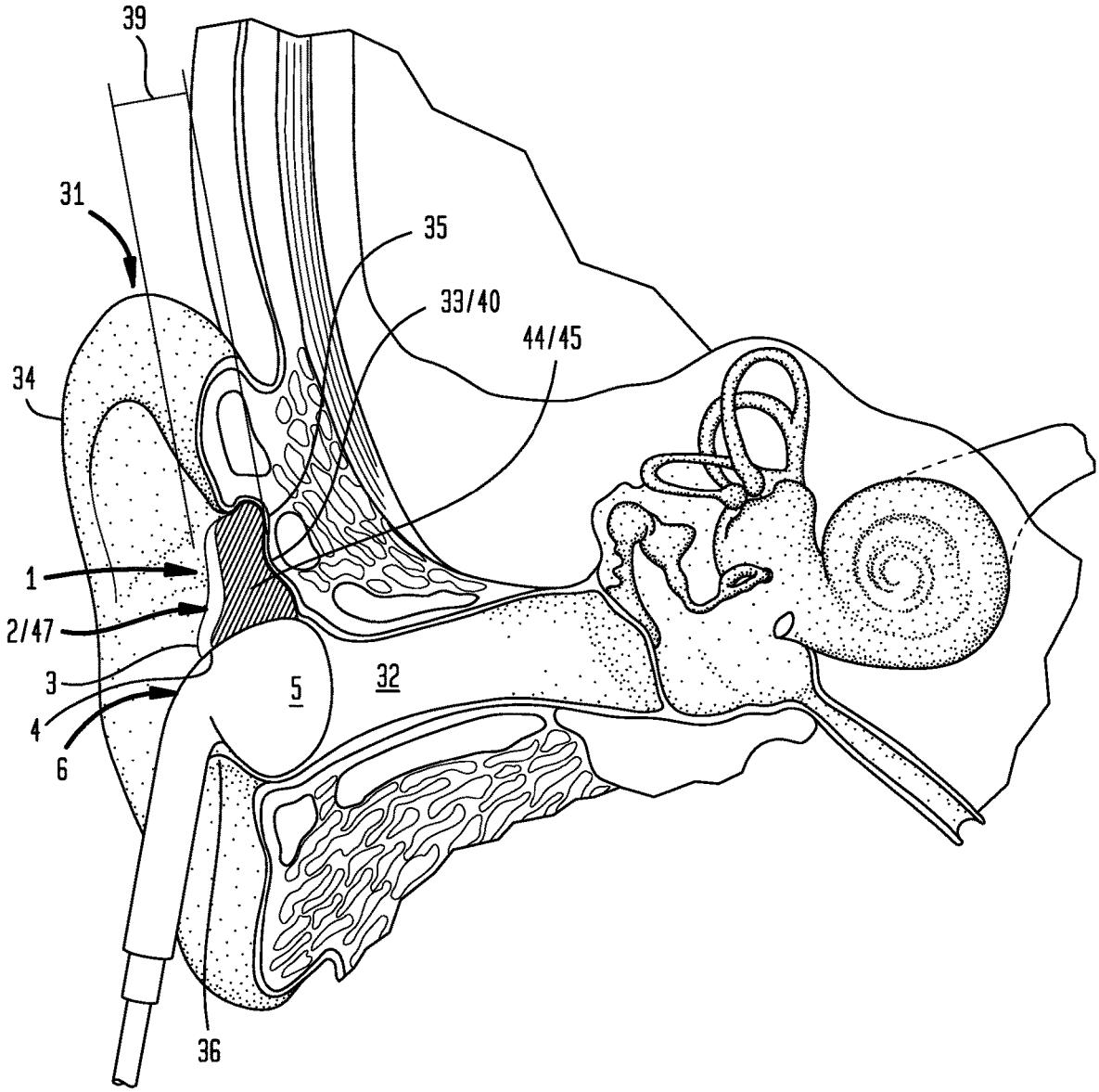
FIG. 13 is a cross-sectional view of an ear and cross-section view of the particular embodiment of the earpiece shown in either one of FIG. 5 or 7 secured to an earphone positioned in the ear.

Now referring generally to FIGS. 13 through 15, the method of using the earpiece (1) can further include reconfiguring the intra-auricular support external surface (3) by engagement with the auricle (30) of the ear (31). Reconfiguration of the intra-auricular support (2) can be achieved prior to or after securing the earphone housing (5) of the earphone (6) to the intra-auricular support base (4) or base member (10). FIGS. 13 and 14 show examples of reconfiguration of the intra-auricular support (2) after securement of the earphone housing (5) of the earphone (6) to the intra-auricular support base (4). FIG. 15 shows an example of reconfiguration of the intra-auricular support (2) after securement of the intra-auricular support (2) fixedly engaged to the base member (10) to a base member securement element (24) of the earphone housing (5) of the earphone (6).

Now referring to primarily to FIG. 13, where the intra-auricular support (2) can be fabricated, formed, or molded from a pliant solid (44), the pliant solid (44) of the intra-auricular support (2) can be reconfigured toward achieving the contour of the concha bowl (33) by pressing engagement of the pliant solid (44) with the concha bowl (33), although other embodiments can have the pliant solid (44) reconfigured toward achieving the contour of the auricle (30) of the ear (31), or combination of the auricle (30) and concha bowl (33), or other reconfiguration of a portion of the auricle (30) of the ear (31).

Again, referring primarily to FIG. 13, as to embodiments of the intra-auricular support (2) which can be fabricated, formed, or molded from a moldable support material (45) defining a first fixed configuration (46) of the intra-auricular support (2) positionable in the auricle (30) of the ear (31) (as illustrated in the examples of FIGS. 9 and 11), the method of using the earpiece (1) can further include heating the moldable support material (45) to achieve a moldable condition, reconfiguring the moldable support material (45) by engagement with the auricle (30) of the ear (31), and cooling the moldable support material (45) while engaged with the auricle (30) of the ear (31) to obtain a second fixed configuration (47) of the intra-auricular support (2) removable from and positionable in the auricle (30) of the ear (31). Reconfiguration of the intra-auricular support (2) after heating can be achieved prior to or after securing the earphone housing (5) of the earphone (6) to the intra-auricular support base (4).

Now referring to FIG. 14, as to embodiments of the intra-auricular support (2) including a pliant outer layer (48) disposed over the moldable support material (45), methods of using the earpiece (1) can further include heating the moldable support material (45) disposed inside of the pliant outer layer (48) to achieve a moldable condition, reconfiguring the moldable support material (45) by engagement of the pliant outer layer (48) with the auricle (30) of the ear (31), and cooling the moldable support material (45) while the pliant outer layer (48) engages the auricle (30) of the ear (31) to obtain the moldable support material (45) defining a second fixed configuration (47) of the intra-auricular support (2) removable from and positionable in the auricle (30) of the ear (31). Reconfiguration of the intra-auricular support (2) can be achieved prior to or after securing the earphone housing (5) of the earphone (6) to the intra-auricular support base (4).

Again, referring primarily to FIG. 14, as to embodiments of the intra-auricular support (2) including a pliant outer layer (48) defining an intra-auricular support external surface (3) and a hollow interior space (53), methods of using the earpiece (1) can further include disposing a moldable support material (45) in the hollow interior space (53) of the pliant outer layer (48) to maintain the intra-auricular support external surface (3) in a first fixed configuration (46), heating the moldable support material (45) disposed inside of the pliant outer layer (48) to achieve a moldable condition, reconfiguring the support material by engagement of the pliant outer layer (48) with the auricle (30) of the ear (31), and cooling the moldable support material (45) while the pliant outer layer (48) engages the auricle (30) of the ear (31) to maintain the moldable support material (45) in a second fixed configuration (47) of the intra-auricular support (2) positionable in the auricle (30) of the ear (31). Reconfiguration of the intra-auricular support (2) can be achieved prior to or after securing the earphone housing (5) of the earphone (6) to the intra-auricular support base (4).

Methods of heating the intra-auricular support (2) to achieve the moldable condition of the intra-auricular support (2) can be accomplished in a variety of ways. As a first illustrative example, the intra-auricular support (2) can be located in a heated enclosure. Where the intra-auricular support (2) in the first fixed configuration (46) is formed from polycaprolactone (or other material(s) having same or similar physical properties), the intra-auricular support (2) can be heated within the heated enclosure having sufficient temperature to achieve the molded condition. As to particular embodiments, the heated enclosure can have a temperature maintained at about 70° C. (160° F.) and the intra-auricular support (2) can be heated within the heated enclosure for about 10 minutes. The intra-auricular support (2) can be removed from the heated enclosure and allowed to sufficiently cool for engagement with the auricle (30) or concha bowl (33) (typically about 30 seconds).

Another method of heating the intra-auricular support (2) can include locating the intra-auricular support (2) in an amount of liquid. The amount of liquid can be any liquid which does not degrade the moldable support material (45) of the intra-auricular support (2) and which can hold a temperature sufficient to heat the intra-auricular support (2) to achieve the moldable condition, such as an oil, alcohol, water, or the like, or combinations thereof. Typically, the amount of liquid will be an amount of water. The amount of liquid can be sufficiently heated to achieve the moldable condition. For example, where the intra-auricular support (2) is made from polycaprolactone polymer, the intra-auricular support (2) can be heated in an amount of water to a temperature of about 60° C. (140° F.) for about 5 minutes. The intra-auricular support (2) can be removed from the heated water and allowed to sufficiently cool for engagement with the auricle (30) or concha bowl (33) (typically about 30 seconds). As to particular embodiments, the intra-auricular support (2) in the first fixed configuration (46) of the external surface disposed in the amount of liquid can be heated by exposing the intra-auricular support (2) disposed in said amount of liquid to an amount of microwave radiation sufficient to achieve the moldable condition.

Another method of heating the intra-auricular support (2) can include locating the intra-auricular support (2) in a flow of heated fluid. The flow of heated fluid can be a flow of heated air; although the invention is not so limited. As to particular embodiments of the intra-auricular support (2) made from polycaprolactone polymer (or other material have the same or similar physical properties), a flow of sufficiently heated air can be obtained from conventional hair dryer. The settings of the hair dryer as to temperature and flow rate can be adjusted to allow the intra-auricular support (2) to be sufficiently heated to achieve the moldable condition, typically, within a period of about one minute to about 2 minutes. The intra-auricular support (2) can be removed from the flow of heated air and allowed to sufficiently cool for engagement with the auricle (30) or concha bowl (33) (typically about 30 seconds). The above illustrative examples are not intended to be limiting with respect to the method of heating the intra-auricular support (2) and other methods of heating the intra-auricular support (2) can be utilized, including, for example, a sand bath or salt bath.

As can be easily understood from the foregoing, the basic concepts of the present invention may be embodied in a variety of ways. The invention involves numerous and varied embodiments of a moldable earpiece system and methods for making and using such moldable earpiece system, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "support" should be understood to encompass disclosure of the act of "supporting"—whether explicitly discussed or not—and, conversely, were there effectively disclosure of the act of "supporting", such a disclosure should be understood to encompass disclosure of a "support" and even a "means for supporting." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same faun, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the moldable earpiece systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. An earpiece, comprising:

an intra-auricular support, including:

a moldable support material defining a first fixed configuration of said intra-auricular support positionable in an auricle of an ear, wherein said moldable support material heatable to achieve a moldable condition which allows reconfiguration of said moldable support material by engagement with said auricle of said ear, wherein said moldable support material coolable while engaged with said auricle of said ear to dispose said moldable support material in a second fixed configuration of said intra-auricular support disposable in said auricle of said ear; and an intra-auricular support base configured to secure to an earphone housing of an earphone, wherein said earphone housing comprises an output opening and a circumference surrounding the output opening, wherein said intra-auricular support base secures to said earphone housing along less than an entirety of said circumference of said earphone housing;

wherein said intra-auricular support secured by said intra-auricular support base to said earphone housing positionable in said auricle of said ear upon insertion of said earphone into said ear.

2. The earpiece of claim 1, further comprising a pliant outer layer disposed over said moldable support material.

3. The earpiece of claim 2 further comprising a base member, said base member having a base member first surface fixedly engaged to said intra-auricular support, said base member having a base member second surface having a fixed configuration securable to said earphone housing of said earphone, said base member upon heating and cooling of said intra-auricular support maintains said fixed configuration securable to said earphone housing of said earphone.

4. The earpiece of claim 2, wherein said moldable support material comprises a one-part moldable earpiece material.

5. The earpiece of claim 2, wherein said moldable support material comprises a moldable agent and a curing agent, wherein combination of said moldable agent and curing agent curable in said second fixed configuration of said earpiece.

6. The earpiece of claim 1, further comprising a base member, said base member having a base member first surface fixedly engaged to said intra-auricular support, said base member having a base member second surface having a fixed configuration securable to said earphone housing of said earphone.

7. The earpiece of claim 6, wherein said base member upon heating and cooling of said intra-auricular support maintains said fixed configuration securable to said earphone housing of said earphone.

8. The earpiece of claim 6, further comprising an adhesion element disposed on said base member, said adhesion element secures said base member to said earphone housing of said earphone.

9. The earpiece of claim 6, wherein said base member comprises a resiliently flexible arcuate body having a flexed condition which allows said earphone housing to pass between opposed arcuate body ends to engage said base member second surface and an unflexed condition which retains said base member on said earphone housing.

10. The earpiece of claim 9, wherein said earphone housing further includes an open sided channel configured to receive said resiliently flexible arcuate body.

11. The earpiece of claim 10, wherein said open sided channel circumferentially extends about said earphone housing, said open sided channel slidably engages said resiliently flexible arcuate body to allow said earphone housing to rotate in relation to said intra-auricular support.

12. The earpiece of claim 1, wherein said moldable support material comprises a one-part moldable earpiece material.

13. The earpiece of claim 1, wherein said moldable support material comprises a moldable agent and a curing agent, wherein combination of said moldable agent and curing agent curable in said second fixed configuration of said earpiece.

14. The earpiece of claim 1, wherein said earphone housing further comprises a socket which mateably engages said intra-auricular support base to removably secure said intra-auricular support to said earphone housing.

* * * * *